US009919439B2

(12) United States Patent
Fu

(10) Patent No.: US 9,919,439 B2
(45) Date of Patent: Mar. 20, 2018

(54) CORDLESS VACUUM HAIRCUT KIT

(71) Applicant: Anming Fu, Shenzhen (CN)

(72) Inventor: Anming Fu, Shenzhen (CN)

( * ) Notice: Subject to any disclaimer, the term of this patent is extended or adjusted under 35 U.S.C. 154(b) by 0 days.

(21) Appl. No.: 15/381,691

(22) Filed: Dec. 16, 2016

(65) Prior Publication Data

US 2017/0182671 A1 Jun. 29, 2017

(30) Foreign Application Priority Data

Dec. 28, 2015 (CN) ..... 2015 2 1100359
Dec. 28, 2015 (CN) ..... 2015 2 1100529

(51) Int. Cl.
*B26B 19/44* (2006.01)
*B26B 19/04* (2006.01)
*B26B 19/38* (2006.01)

(52) U.S. Cl.
CPC ..... *B26B 19/44* (2013.01); *B26B 19/04* (2013.01); *B26B 19/3886* (2013.01)

(58) Field of Classification Search
CPC ..... B26B 19/44; B26B 19/28; B26B 19/02; B26B 19/382; B26B 19/04; B26B 19/3886; Y10T 83/04
USPC ..... 30/195, 34.05, 43.92, 133, 208, 43.9, 30/43.6, 41.5
See application file for complete search history.

(56) References Cited

U.S. PATENT DOCUMENTS 2,245,917 A * 6/1941 Hill ..... B26B 19/44 30/41.5
2,748,472 A * 6/1956 Sheley ..... B26B 19/44 30/133
2,916,821 A * 12/1959 Witmer ..... B26B 19/44 30/133
3,440,681 A * 4/1969 Wahl ..... B26B 19/44 15/339
6,948,248 B2 * 9/2005 Andis ..... B26B 19/02 30/195
6,986,206 B2 * 1/2006 McCambridge ..... B26B 19/063 30/133
7,975,385 B2 * 7/2011 Obermann ..... B26B 19/44 30/133
2002/0108255 A1 * 8/2002 Degregorio, Jr. ..... B26B 19/44 30/133
2006/0174487 A1 * 8/2006 Andis ..... B26B 19/06 30/34.05
2015/0224656 A1 * 8/2015 Johnson ..... B26B 19/44 30/133

* cited by examiner

*Primary Examiner* — Ghassem Alie
(74) *Attorney, Agent, or Firm* — Wayne & Ken, LLC; Tony Hom

(57) ABSTRACT

The invention relates to a cordless vacuum haircut kit. The cordless vacuum haircut kit includes a front upper housing, a back upper housing, a lower housing and a first motor. The cordless vacuum haircut kit is provided with an air flow chamber, a hair suction port, an air outlet and a hair storage chamber. The hair storage chamber is provided with a window, a wind impeller driven by a second motor and an exhaust outlet. The invention is integral, small in volume, and convenient in operation and has function of broken hair suction.

9 Claims, 6 Drawing Sheets

CORDLESS VACUUM HAIRCUT KIT

TECHNICAL FIELD

The invention relates to haircut device field, and more specifically, to a cordless vacuum haircut kit.

BACKGROUND OF THE INVENTION

In existing electric hair clipper, during hair cutting, the broken hair falls on the neck, vest, clothing, ground and so on, resulting in itching and uncomfortable of human and staining on clothes. Cloak of the professional barbershop can prevent falling of broken hair, however, some broken hair still falls on the exposed neck, and airtight cloak around the neck makes people feel uncomfortable during hair cutting. Babies and children are especially reluctant to wear cloak, and cloak cannot completely solve the problem that broken hair falling on the neck. The broken hair on the neck results in itching, even skin allergy due to delicate skin of babies and children, thus the purpose of cutting hair cannot be realized.

A split vacuum hair clipping device was developed. The split vacuum hair clipping device places device with vacuum function on the ground, and the device is connected with the hair suction port of the hair clipping device by a long hose, thus realizing both hair cutting and hair suction. However, the hair clipping device has some disadvantages due to bigger volume: 1. The hair clipping device is bulky; 2. It is inconvenient for the operation of hair clipping device when connecting with a long hose during hair cutting; 3. It is very inconvenient to cut hair when the hair clipping device is connected with the device with vacuum function by a long hose; 4. People feeling uncomfortable when a long hose wound around human body; 5. Vacuum pressure loss due to the long hose; and 6. Some broken hair still falls on the neck or the body, so that the split vacuum hair clipping device cannot be used widely.

SUMMARY OF THE INVENTION

The purpose of the invention is to overcome the shortcomings existed in the prior art by providing an integral cordless vacuum haircut kit with small volume, easy operation and function of broken hair suction. The invention is simple and compact in structure, the hair storage chamber can be taken out rapidly, the door of the hair storage chamber can be opened rapidly to empty the storage chamber. The hair storage chamber is thus improved with small volume, so the invention has strong applicability. The transparent hair blocking cover provided at the head of the hair clipping device can prevent the broken hair falling off.

The purpose of the present invention is realized by following technical schemes:

A cordless vacuum haircut kit, comprising a front upper housing, a back upper housing and a lower housing; the front upper housing and the back upper housing are respectively fastened on the lower housing; the front upper housing and the back upper housing are connected in a sealing manner, a detachable first motor is fixedly arranged in a chamber formed by the front upper housing and the lower housing, a cutter head for cutting hair is provided in front end of the lower housing, the cutter head is driven by the first motor through an eccentric shaft, and a battery and an PCBA are arranged in a chamber formed by the back upper housing and the lower housing, a charging interface is provided at the back end of the lower housing; and the lower housing located at one side of the first motor is provided with an electrified switch, characterized in that the front upper housing located above the first motor is provided with an air flow chamber, a hair suction port located at the front end of the air flow chamber and above the cutter head is connected with the air flow chamber, and the back end of the air flow chamber is provided with an air outlet connected with the air flow chamber, a hair storage chamber connected with the air outlet in a sealing manner is arranged at the back of the air outlet and the first motor; the hair storage chamber is provided with a window and an openable and closable door for blocking the window; a wind impeller connected with the hair storage chamber in a sealing manner is arranged at back end of the hair storage chamber, the wind impeller is driven by a second motor at back end of the wind impeller located in the chamber formed by the back upper housing and the lower housing, an exhaust outlet connected with the wind impeller is provided at the bottom of the lower housing. Further, the second motor is fixedly and detachably arranged above the battery through the support on the bottom of the lower housing.

Preferably, a filtering net rack is provided at a joint position between the back end of the hair storage chamber and the wind impeller, the filtering net rack is provided with a filtering net, and a filtering net rack seal ring is arranged around the filtering net rack.

Preferably, an air flow seal ring is provided at a joint position between the front end of the hair storage chamber and the air outlet.

Preferably, the hair suction port is fixedly provided with a detachable and transparent hair blocking cover for preventing the broken hair falling off. And users can observe length of haircut and other situations through the transparent cover. Insert the transparent cover when needed, and pull it out when not needed.

Preferably, the switch is provided with at least two gears, one is only for haircut and the other is for both haircut and hair suction, which is convenient for users to use flexibly.

Preferably, the air flow chamber is a structure with integrated front upper housing with four sealed sides, ventilating front end and ventilating back end.

Preferably, the hair storage chamber is formed by the back end of the front upper housing, the front end of the back upper housing and the lower housing with four sealed sides, both ends of the hair storage chamber are connected with the outlet and an air inlet of the wind impeller.

Preferably, the hair storage chamber is formed by the front upper housing, the back upper housing and the lower housing, and a chamber seal ring is provided at the joint position for sealing the hair storage chamber.

Preferably, the top of the hair storage chamber is provided with a sealed transparent cover for observing an inner side of the hair storage chamber from outside.

Preferably, the window of the hair storage chamber is arranged on the bottom of the hair storage chamber.

Preferably, one end of the door is connected with lower part of the hair storage chamber through the pin shaft and torsion spring, the pin shaft can rotate as a rotational center axis of the door, thus opening or closing the door. The other end of the door is provided with a reversing button, when the door is closed, the door barb 48 of the door self-locking push button 40 sliding back and forth on the lower housing 12 is caught by the reversing button.

Preferably, the joint position of the door and the hair storage chamber is provided with a door seal ring.

Another preferred scheme is the hair storage chamber is arranged between the air outlet and the wind impeller and the hair storage chamber is fixedly detachable.

Preferably, the hair storage chamber adopts transparent plastic.

Preferably, one side of the hair storage chamber is provided with a buckle fixed with the lower housing, a boss is provided at the bottom of the hair storage chamber, and the boss passes through a hole correspondingly arranged in the lower housing.

The present invention has the following beneficial effects.

The invention is an integral design, the broken hair can be sucked away during cutting hair, which solves the problem of itching due to broken hair on the neck.

The invention provides a cordless vacuum haircut kit with small volume, simple and compact structure, easy and practical operation.

The hair storage chamber of the invention can be emptied rapidly, the door can be opened rapidly to empty the hair, and hair storage chamber is improved with small volume. So the invention has strong applicability.

The hair storage chamber of the invention adopts transparent materials to see whether the hair storage chamber is filled with hair.

The transparent hair blocking cover of the invention has effect of preventing the broken hair falling off.

The switch of the invention is provided with two gears, one is only for haircut and the other is for both haircut and hair suction, which is convenient for users to use flexibly.

REFERENCE NUMBERS OF DRAWINGS

10—front upper housing, 11—back upper hosing, 12—lower housing, 13—hair suction port, 14—cutter head, 15—hair blocking cover, 16—eccentric shaft, 17—first motor, 18—air flow chamber, 19—switch, 20—hair storage chamber, 21—air flow seal ring, 22—filtering net rack seal ring, 23—filtering net, 24—filtering net rack, 25—inlet of wind impeller, 26—boss, 27—air outlet, 28—window, 29—exhaust outlet, 30—second motor, 31—wind impeller, 32—battery, 33—PCBA, 34—charging interface, 40—door self-locking push button, 41—spring, 42—transparent cover, 43—pin shaft, 44—door, 45—torsion spring, 46—chamber seal ring, 47—door seal ring, 48—door barb.

DETAILED DESCRIPTION OF THE INVENTION

The embodiments of the invention are explained as follows with reference to drawings.

Embodiment 1

Figure 1:
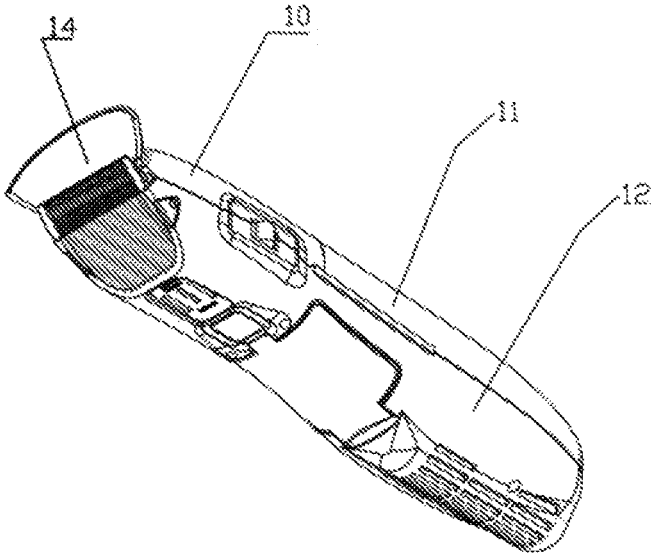
FIG. 1 is a space structure diagram of embodiment 1 of the invention.
Figure 2:
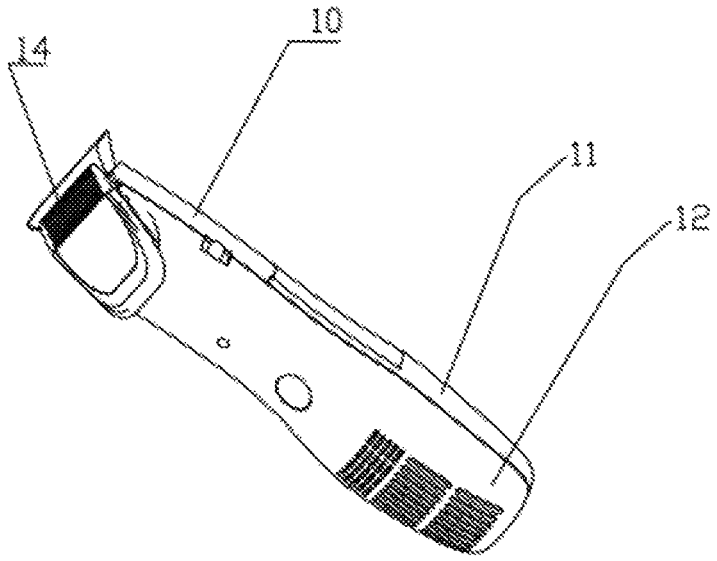
FIG. 2 is a space structure diagram of embodiment 2 of the invention.
Figure 3:
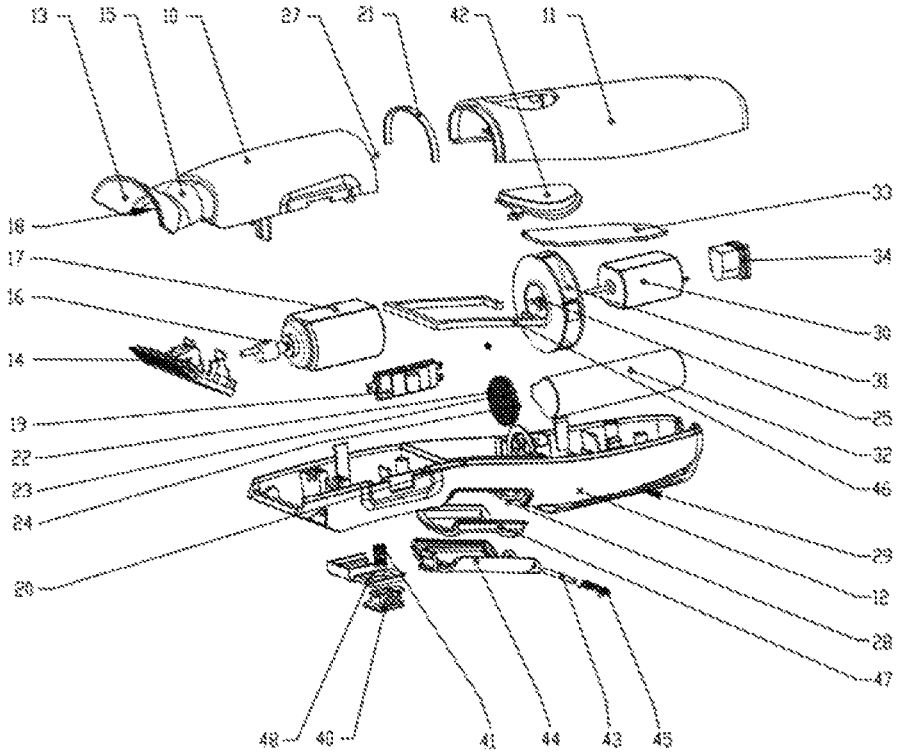
FIG. 3 is an assembly diagram of embodiment 1 of the invention.
Figure 4:
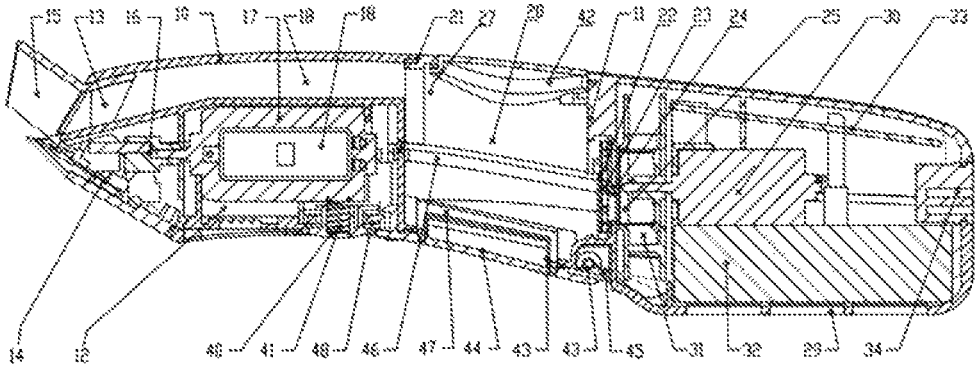
FIG. 4 is a longitudinal section view of embodiment 1 of the invention.
Figure 5:
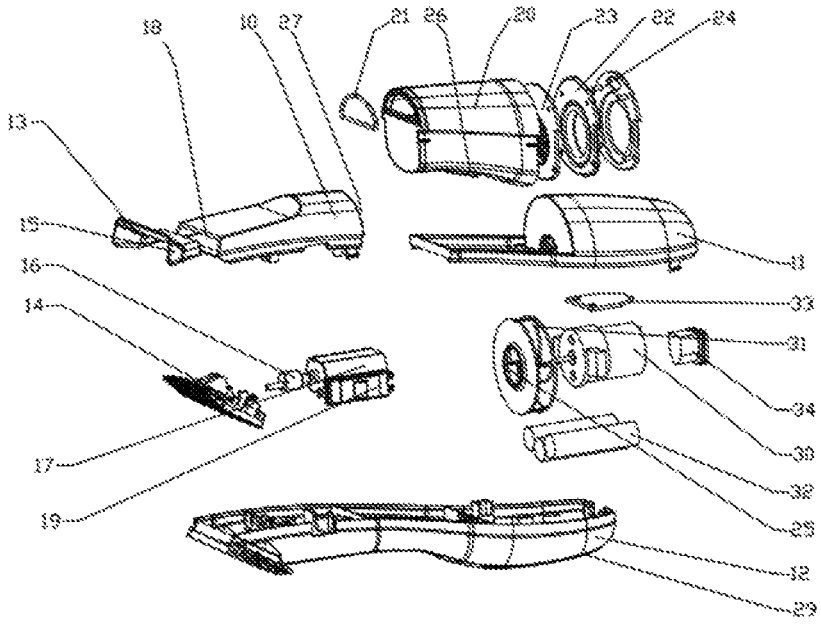
FIG. 5 is an assembly diagram of embodiment 2 of the invention.
Figure 6:
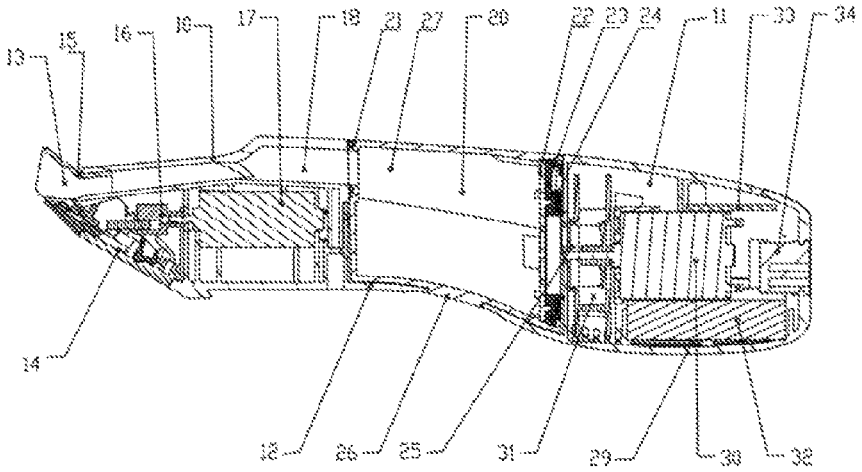
FIG. 6 is a longitudinal section view of embodiment 2 of the invention.

As shown in FIG. 1, FIG. 2 and FIG. 3, a cordless vacuum haircut kit comprises a front upper housing 10, a back upper housing 11 and a lower housing 12; the front upper housing 10 and the back upper housing 11 are respectively fastened on the lower housing 12; the front upper housing 10 and the back upper housing 11 are connected in a sealing manner, a detachable first motor 17 is fixedly arranged in a chamber formed by the front upper housing 10 and the lower housing 12, a cutter head 14 for cutting hair is provided in front end of the lower housing 12, the cutter head 14 is driven by the first motor 17 through an eccentric shaft 16, so that the blade swings to the left and right for cutting hair, and a chargeable battery 32 and an PCBA 33 are arranged in a chamber formed by the back upper housing 11 and the lower housing 12, the battery 32 is fixedly and detachably arranged on the bottom of the lower housing 12, the battery 32 supplies power to the first motor 17 and the second motor 30, and the PCBA 13 is fixedly and detachably arranged on the back upper housing 11, the joint position between the back end of the lower housing 12 and the back upper housing 11 is provided with a charging interface 34, the charging interface is electrically connected with the charging battery 32, and the lower housing 12 located at one side of the first motor 17 is provided with an electrified switch 19, the battery 32 is electrically connected with the switch 19, the front upper housing 10 located above the first motor 17 is provided with an air flow chamber 18, a hair suction port 13 located at the front end of the air flow chamber 18 and above the cutter head 14 is connected with the air flow chamber 18, and the back end of the air flow chamber 18 is provided with an air outlet 27 connected with the air flow chamber 18. The preferred embodiment is the air flow chamber 18 is a structure with integrated front upper housing 10, four sealed sides, ventilating front end and ventilating back end. The bottom of the hair storage chamber 20 is provided with a window 28 and an openable and closable door 44 for blocking the window 28, the joint position between the door 44 and the hair storage chamber 20 is provided with a door seal ring 47. The back end of the hair storage chamber 20 is provided with a wind impeller 31 connected with the hair storage chamber in a sealing manner, the wind impeller 31 is driven by a second motor 30 at the back end of the wind impeller 31 located in a chamber formed by the back upper housing 11 and the lower housing 12, an exhaust outlet 29 connected with the wind impeller 31 is provided at the bottom of the lower housing 12. A preferred embodiment is the second motor 30 is fixedly and detachably arranged above the battery 32 through the support of the bottom of the lower housing 12.

A filtering net rack 24 is provided at the joint position between the back end of the hair storage chamber 20 and the wind impeller 31, the filtering net rack 24 is provided with a filtering net 23, a filtering net rack seal ring 22 is arranged around the filtering net rack 24, when the second motor 30 starts the wind impeller 31 for wind suction, the broken hair is blocked in the hair storage chamber 20 by the filtering net 23, and the wind is exhausted by the exhaust outlet.

An air flow seal ring 21 is provided at the joint position between the front end of the hair storage chamber 20 and the air outlet 27.

The hair suction port 13 is provided with a fixedly detachable and transparent hair blocking cover 15 for preventing the broken hair falling off.

And users can observe length of haircut and other situations through the transparent cover. Insert the transparent cover when needed, and pull it out when not needed.

A preferred embodiment is the switch 19 is provided with at least two gears, the switch 19 is electrically connected with the first motor 17 and the second motor 30, one gear is only for haircut and the other gear is for both haircut and hair suction, which is convenient for users to use flexibly.

A preferred embodiment is the hair storage chamber is formed by the front upper housing 10, the back upper housing 11 and the lower housing 12, and a chamber seal ring 46 is provided at the joint position for sealing the hair storage chamber 20.

A preferred embodiment is the top of the hair storage chamber 20 is provided with a sealed transparent cover 42 for observing the inner side of the hair storage chamber from the outside, whether the hair storage chamber 20 is filled with hair can be seen from the transparent cover 42.

A preferred embodiment is one end of the door 44 is connected with the lower part of the hair storage chamber 20 by the pin shaft 43 and the torsion spring 45, the pin shaft 43 can rotate as a rotational center axis of the door 44, thus opening or closing the door, the other end of the door 44 is provided with a reversing button, when the door 44 is closed, the door barb 48 of the door self-locking push button 40 sliding back and forth on the lower housing 12 is caught by the reversing button, the door self-locking push button 40 is provided with a spring 41 connected with the lower housing. When the hair storage chamber 20 is filled with hair, gently push forward the door self-locking push button 40, the door barb 48 on the door self-locking push button 40 is disengaged with the reversing button on the door 44. The door 44 opens naturally under elastic force of the torsion spring 45. And the filled hair will fall into the garbage can automatically. Therefore, the hair in the hair storage chamber 20 can be emptied rapidly, and the hair storage chamber 20 can be small, so the volume of the product is also small.

Embodiment 2

As shown in FIG. 2, FIG. 3, FIG. 5 and FIG. 6, the differences with the embodiment 1 are as follows, as an independent structure, the hair storage chamber 20 adopts transparent plastic preferably. The hair storage chamber 20 is arranged between the air outlet 27 and the wind impeller 31 and is fixedly detachable. A buckle fixed with the lower housing is provided at one side of the hair storage chamber 20, a boss 26 is provided at the bottom of the hair storage chamber, and the boss 26 passes through a hole position arranged in the lower housing and is exposed out of the lower housing 12. If the boss 26 is pushed upward, the hair storage chamber 20 can be easily taken out, then the filtering net rack 24 is taken out to empty the hair in the hair storage chamber 20. The embodiment has no transparent cover 42, window 28, door 44, pin shaft 43, torsion spring 45, spring 41, door self-locking push button 40 and door barb 48 of embodiment 1. Other similarities with embodiment 1 will not be repeated herein.

The embodiment of the invention is when the switch 19 is open, the first motor 17 drives the cutter head 14 for cutting hair, if function of broken hair suction is needed, open the switch with the other gear, and the second motor 30 works simultaneously, the second motor 30 drives the wind impeller 31 to rotate at high speed, thus producing negative pressure airflow. Wind of the hair storage chamber 20, the air outlet 27 and the wind impeller 31 can only be sucked from the hair suction port 13, so that the clipped broken hair enters into the hair storage chamber 20 from the hair suction port 13 through the air flow chamber 18. And the wind passes through the filtering net 23 into the air inlet 25 of the wind impeller 31 and is discharged at high speed by the wind impeller 31 and exhausted by the exhaust outlet at end of the lower housing 12. The broken hair is blocked in the hair storage chamber 20 by the filtering net 23, when the broken hair needs to be pour out, just pour the hair in the hair storage chamber 20 out.

Above disclosure are merely some preferred embodiments of the invention, and the invention is not limited to this. Any variations, equivalent replacement and improvements within the spirit and principle of the invention shall be included in the protection scope of the invention.

What is claimed is:

1. A cordless vacuum haircut kit, comprising a front upper housing, a back upper housing and a lower housing; the front upper housing and the back upper housing are respectively fastened on the lower housing; the front upper housing and the back upper housing are connected in a sealing manner, a detachable first motor is fixedly arranged in a chamber formed by the front upper housing and the lower housing; a cutter head is provided in front end of the lower housing; the cutter head is driven by the first motor through an eccentric shaft, and a battery and an printed circuit board assembly (PCBA) are arranged in a chamber formed by the back upper housing and the lower housing, a charging interface is provided at the back end of the lower housing; and the lower housing located at one side of the first motor is provided with an electrified switch, characterized in that the front upper housing located above the first motor is provided with an air flow chamber; a hair suction port located at the front end of the air flow chamber and above the cutter head is connected with the air flow chamber, the hair suction port is fixedly provided with a detachable and transparent hair blocking cover, and the back end of the air flow chamber is provided with an air outlet connected with the air flow chamber, a hair storage chamber connected with the air outlet in a sealing manner is arranged at the back of the air outlet and the first motor; the hair storage chamber is provided with a window and an openable and closable door for blocking the window; a wind impeller connected with the hair storage chamber in a sealing manner is arranged at back end of the hair storage chamber, the wind impeller is driven by a second motor at back end of the wind impeller located in the chamber formed by the back upper housing and the lower housing, an exhaust outlet connected with the wind impeller is provided at the bottom of the lower housing.

2. The cordless vacuum haircut kit according to claim 1, characterized in that the electrified switch is provided with at least two gears.

3. The cordless vacuum haircut kit according to claim 1, characterized in that the air flow chamber is a structure with integrated front upper housing, four sealed sides, ventilating front end and ventilating back end.

4. The cordless vacuum haircut kit according to claim 1, characterized in that the hair storage chamber is formed by the back end of the front upper housing, the front end of the back upper housing and the lower housing with four sealed sides, both ends of the hair storage chamber are connected with the air outlet and an air inlet of the wind impeller.

5. The cordless vacuum haircut kit according to claim 4, characterized in that the top of the hair storage chamber is provided with a sealed transparent cover for observing an inner side of the hair storage chamber from outside.

6. The cordless vacuum haircut kit according to claim 1, characterized in that the hair storage chamber is arranged between the air outlet and the wind impeller, and the hair storage chamber is fixedly detachable.

7. The cordless vacuum haircut kit according to claim 6, characterized in that one side of the hair storage chamber is provided with a buckle fixed with the lower housing; a boss is provided at the bottom of the hair storage chamber, and the boss passes through a hole position arranged in the lower housing.

8. The cordless vacuum haircut kit according to claim 1, characterized in that a filtering net rack is provided at a joint position between the back end of the hair storage chamber and the wind impeller, the filtering net rack is provided with a filtering net, and a filtering net rack seal ring is arranged around the filtering net rack.

9. The cordless vacuum haircut kit according to claim 1, characterized in that an air flow seal ring is provided at a joint position between the front end of the hair storage chamber and the air outlet.

* * * * *